US005527150A

United States Patent [19]

Windhofer

[11] Patent Number: 5,527,150

[45] Date of Patent: Jun. 18, 1996

[54] REGENERATIVE PUMPS

[75] Inventor: Peter F. Windhofer, Subiaco, Australia

[73] Assignee: Orbital Engine Company (Australia) Pty. Limited, Balcatta, Australia

[21] Appl. No.: 351,317

[22] PCT Filed: Aug. 20, 1993

[86] PCT No.: PCT/AU93/00428

§ 371 Date: Dec. 19, 1994

§ 102(e) Date: Dec. 19, 1994

[87] PCT Pub. No.: WO94/04826

PCT Pub. Date: Mar. 3, 1994

[30] Foreign Application Priority Data

Aug. 21, 1992 [AU] Australia ..... PL4227

[51] Int. Cl.[6] ..... F04D 5/00; F04D 29/16

[52] U.S. Cl. ..... 415/55.400; 415/55.1

[58] Field of Search ..... 415/55.1, 55.3, 415/55.4

[56] References Cited

U.S. PATENT DOCUMENTS

| | | | |
|---|---|---|---|
| 3,545,890 | 12/1970 | Hubbard et al. | 415/55.3 X |
| 3,942,906 | 3/1976 | Schönwald . | |
| 4,412,781 | 11/1983 | Abe et al. | 415/55.4 |
| 4,749,338 | 7/1988 | Galtz | 415/145 |
| 4,824,322 | 4/1989 | Middleton | 415/53 |
| 5,143,511 | 9/1992 | Verneau et al. | 415/55.4 |

FOREIGN PATENT DOCUMENTS

| | | | |
|---|---|---|---|
| 49981 | 12/1972 | Australia . | |
| 2305619 | 3/1975 | France . | |
| 499484 | 6/1930 | Germany | 415/55.4 X |
| 501663 | 7/1930 | Germany | 415/55.1 X |
| 81210938 | 8/1981 | Taiwan . | |
| 81217699 | 3/1993 | Taiwan . | |
| 2243650 | 11/1991 | United Kingdom | 415/55.1 X |

*Primary Examiner*—Edward K. Look
*Assistant Examiner*—Michael S. Lee
*Attorney, Agent, or Firm*—Nikaido Marmelstein Murray & Oram

[57] ABSTRACT

Disclosed is a regenerative pump (1) comprising a casing (11) provided with an inlet port (2) for admission of fluid to the pump (1), an impeller (3) having a plurality of blades (4, 14, 23), each having an inner edge (26) and an outer edge (25) in the radial direction of the impeller (3) to generate, upon rotation, multi-stage compression of the admitted fluid and an outlet port (5) for discharge of fluid compressed by the pump (1) from the casing (11). The inlet port (2) is isolated from the outlet port (5) by a stripper portion (6) and the stripper portion (6) and the blades are relatively configured such that an outer edge (25) of each blade (4, 14, 23) enters the stripper portion (6) after an inner edge (26) thereof.

13 Claims, 4 Drawing Sheets

REGENERATIVE PUMPS

BACKGROUND OF THE INVENTION

This invention relates to regenerative pumps and in particular to a type of pump that is suitable for use in supplying compressed air to an internal combustion engine, in which context it is commonly referred to as a regenerative blower.

SUMMARY AND OBJECT OF THE INVENTION

A regenerative pump basically comprises a rotating impeller with a plurality of radial blades located within a casing. The impeller draws a fluid such as air or other gas through an inlet port into the pump casing. Upon contact with an impeller blade the fluid is forced radially outward toward the wall of the casing and follows the wall radially inwardly until it is again drawn into contact with another blade and the process continues by centrifugal force. Because the impeller is designed with a plurality of radial blades such that fluid is compressed many times during its passage through the pump in that air forced radially outward by a blade is recompressed by a succeeding blade thus generating the effect of a multi-stage compressor, relatively high pressures can be generated at the outlet port.

The great advantage of such pumps is that by reliance on multiple passes through the blades rather than high speeds and many moving parts to develop pressure, component life is generally much longer. Indeed the life of such a pump is limited typically only by the life of the bearings which support the impeller shaft. In addition, as lubricants are not present within the housing, gas produced by the pump is much cleaner than that produced by some other types of compressor.

However, when used for applications which place a premium on reducing the size and weight of components, regenerative pumps, as presently designed, have a great disadvantage in that it is not possible to generate desired pressures without increasing the size of the pump to unacceptable levels. This is particularly so when the pump is used as a blower for internal combustion, such as automotive, engines.

One source of this problem is an inherent characteristic of the pump known as "carryover loss". Carryover loss is caused by loss of compressed fluid trapped between the blades when passing through a stripper portion which isolates the inlet port from the outlet port, the sealing being achieved by a close fit of the blades within the walls of the stripper portion. Such loss directly impacts on the compressive capacity of the pump by reducing the volume of fluid that passes through the pump at the required compression.

This problem is compounded by the actual design of the stripper portion. The stripper portion typically extends along a significant portion of the periphery of the blower casing and no compression can take place in this area because the walls defining the stripper are in sealing proximity with the impeller blades such that no air can pass through the blades to generate a compressive effect. In known blowers, the stripper portion, in combination with the inlet and outlet ports, embraces a significant proportion of the circumference of the impeller and, as such, a substantial proportion of the compressive capacity of the blower is unable to be utilized.

Therefore, there is a need, especially in the case of blowers for internal combustion engine, particularly automotive engine, applications to develop a pump that has as high a compressive capacity as possible for a given circumference.

With this object in view, the present invention provides a regenerative pump comprising a casing provided with an inlet port for admission of fluid to said pump, an impeller having a plurality of blades to generate, upon rotation, multistage compression of said admitted fluid and an outlet port for discharge of compressed fluid from the casing, the inlet port being isolated from the outlet port by a stripper portion, said blades having an inner edge and an outer edge with respect to the radial disposition of the blades, wherein said stripper portion and said blades are relatively configured such that said outer edge of each blade enters said stripper portion after said inner edge has entered said stripper portion.

Preferably, the outer edge is the last portion of the blade to enter the stripper portion.

Preferably, the outer edge of each blade leaves the stripper portion before the inner edge thereof.

Conveniently, the stripper portion and blades are relatively configured such that entrapped fluid may exit the cavity between adjacent blades as soon as the outer edge of the blade exits the stripper portion. Preferably, the outer edge is the first portion of each blade to exit the stripper. In such a way, the jet entrainment and spiral motion of the fluid highly beneficial to the operation of the blower may be promoted.

Preferably, the stripper portion is located substantially coextensive in the axial direction to one of the ports and may be provided such that influent fluid may pass over the stripper portion enhancing the efficiency of the inlet portion. In this manner, the proportion of the circumference of the impeller embraced by the combination of the stripper portion and the inlet port may be reduced, thus increasing the compressive capacity of the blower.

Conveniently, the inlet and outlet ports may themselves overlap in the circumferential direction and, preferably, the inlet and outlet ports are designed to be tangential to the casing.

In a further embodiment, the invention provides a regenerative pump comprising a casing provided with an inlet port for admission of fluid to said pump, an impeller having a plurality of blades to generate, upon rotation, multi-stage compression of said admitted fluid and an outlet port for discharge of compressed fluid from the casing, the inlet port being isolated from the outlet port by a stripper portion and said blades having an inner edge and an outer edge with respect to the radial disposition of the blades, wherein said stripper portion and said blades are relatively configured such that said outer edge of each blade exits said stripper portion before said inner edge thereof.

Preferably, the outer edge of each blade is the first portion of the blade to exit the stripper portion.

Conveniently, the stripper portion is located substantially coextensive in the axial direction to one of the ports. If desired, to obtain a flat construction, the blower may be constructed with an inlet port of smaller axial dimension than circumferential dimension. Furthermore, it is desirable to provide a construction where a substantial proportion of influent fluid may flow over or around the stripper portion.

The advantage of adopting each of the features of the above construction is that the effect of the carryover loss is reduced and a greater portion of the peripheral length of the impeller is available for compression of the fluid. Thus, the pump size is physically smaller for a given discharge pressure than known pumps. It follows that, in engine applications, the total size and weight of the engine installation may be reduced.

The invention will now be described, in greater particularity, with reference to the accompanying drawings which illustrate a preferred embodiment thereof, in which the fluid to be compressed is a gas, such as air. The fluid could equally be a liquid or a gas other than air and the nature of the fluid utilized forms no part of the present invention.

DETAILED DESCRIPTION OF THE DRAWINGS

Figure 1:
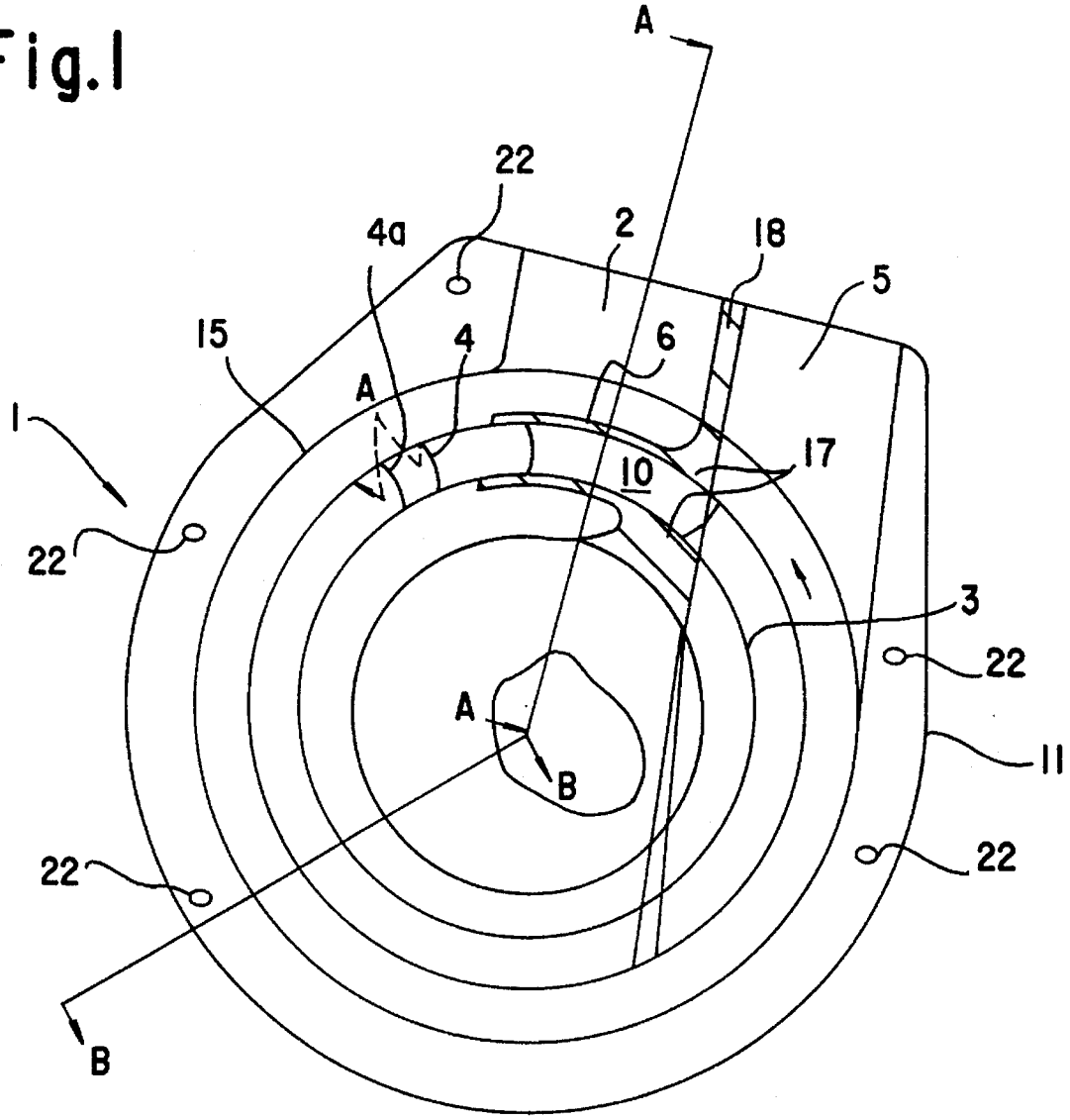
FIG. 1 shows a sectional view of the casing of a pump designed in accordance with one embodiment of the present invention.

Turning now to FIG. 1, the regenerative pump 1, or blower, comprises a casing 11 provided with an inlet port 2 for admission of fluid to be compressed for use, for example, to supply a gas such as air to the cylinders of an engine at an above atmospheric pressure. However, it will be understood that there is no limitation upon the fluids that can be compressed in the blower 1 of the invention.

The blower casing 11, is constructed in two casing portions, one of which is seen in FIG. 1, which, by way of bolt holes 22, may be attached of a complementary casing portion (not shown). Within the blower casing 11, there is located a counter clockwise rotatable impeller 3 provided with a plurality of radial blades 4. Only a few of these blades 4 are shown for the purposes of clear illustration. The blades 4 are designed as discussed hereinbelow and such as to generate the maximum degree of compression of the air. The spacing of the blades 4 is determined in accordance with conventional practice to achieve the object of maximum compression of air. The blades 4 can be made of any suitable material, but of course, the material should preferably be lightweight, such as aluminium alloy, to minimize the weight of the blower 1.

The blower casing 11 is also provided with an outlet port 5 allowing discharge of compressed air from the casing 11 for supply to the engine cylinders as discussed above. The outlet port 5 is isolated from the inlet port 2 by a stripper portion 6. The stripper portion 6 is constructed in the form of an inverted channel shaped passage providing a minimal clearance between the edges 25, 26 and 27 of the blades 4 to provide a seal between the inlet and outlet ports 2 and 5 of the blower. It will be noted, in particular, that the stripper portion 6 is located in a substantially overlapping relation in the peripheral direction with the inlet port 2, thus increasing the proportion of the peripheral length of the impeller 3 available for compressing the gas, but such as to not impair the flow of incoming air drawn into the blower casing 11.

Further, the stripper portion 6 extends a distance in the circumferential direction of the impeller 3 and is positioned such that air may flow from the inlet port 2 over the roof thereof, such that the stripper portion 6 does not impede the inflow of air and the stripper is efficiency is maximized.

Figure 2A:
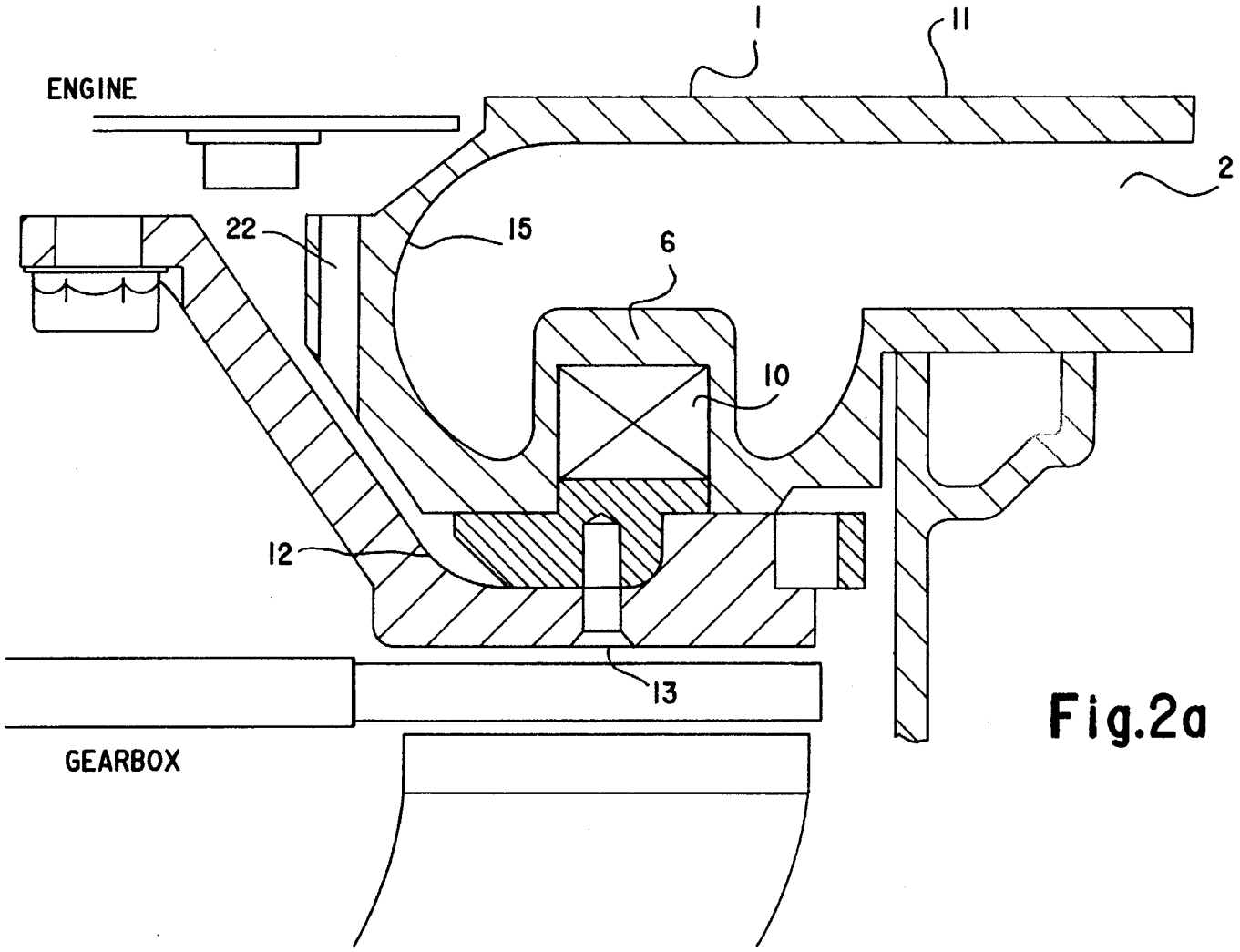
FIG. 2*a* shows a section along line A—A in FIG. 1.
Figure 2B:
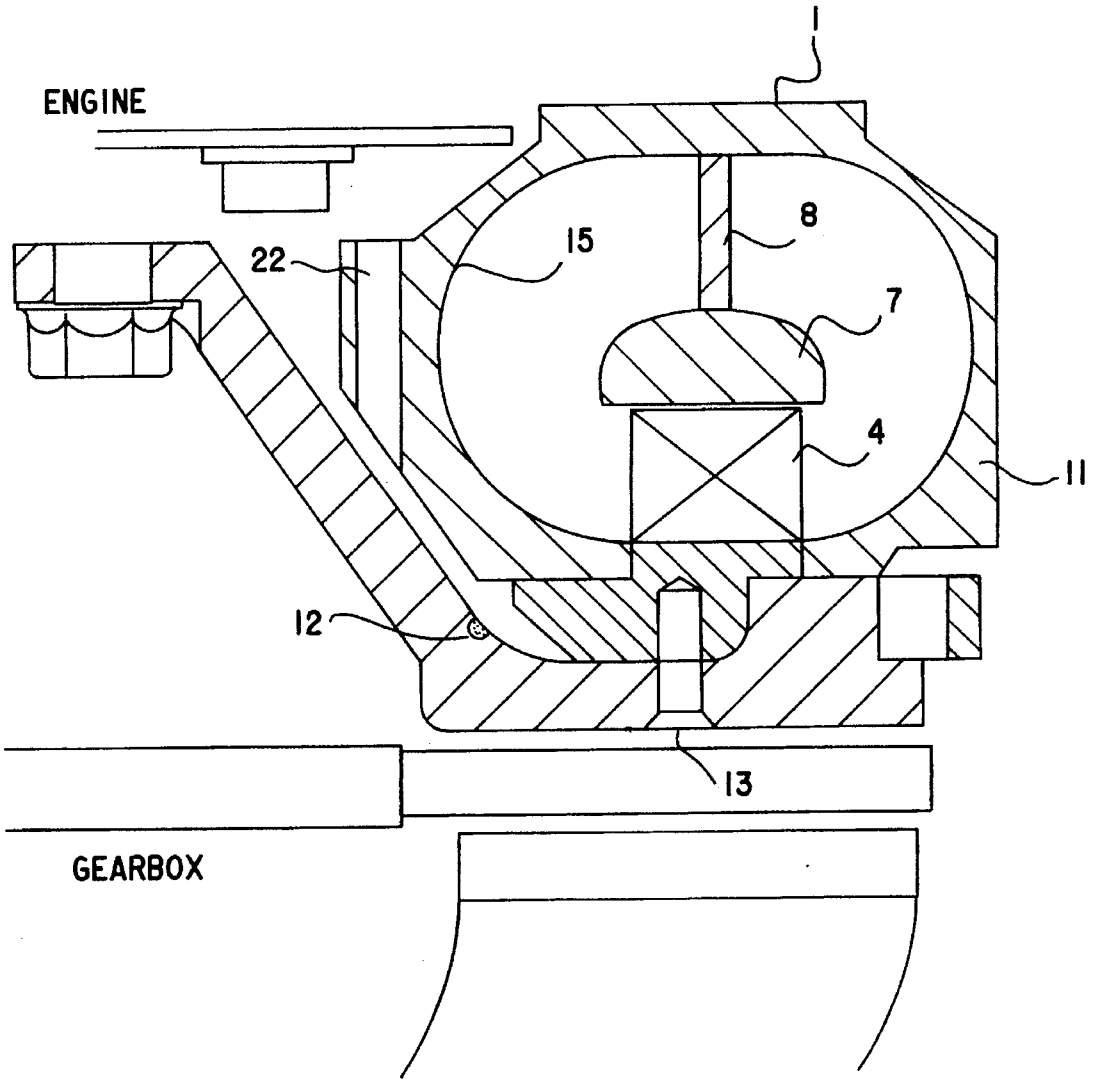
FIG. 2*b* shows a section along line B—B in FIG. 1.

Referring now to FIG. 2*b*, there is shown a section along line B—B of FIG. 1 in which there is shown a metal guide ring 7 supported by bolts 8 disposed in close proximity to the blades 4. The guide ring 7 extends around the circumference of the impeller 3 to the stripper portion 6 and also ensures that a spiral flow of air radially outward toward outer circumferential wall 15 of the casing is maintained, by providing a barrier preventing radially inward eddies of air. Also, though not shown here, the axial dimension of the guide ring 7 varies along its circumferential length so as to maximize the fluid dynamic efficiency of the blower 1.

Figure 4:
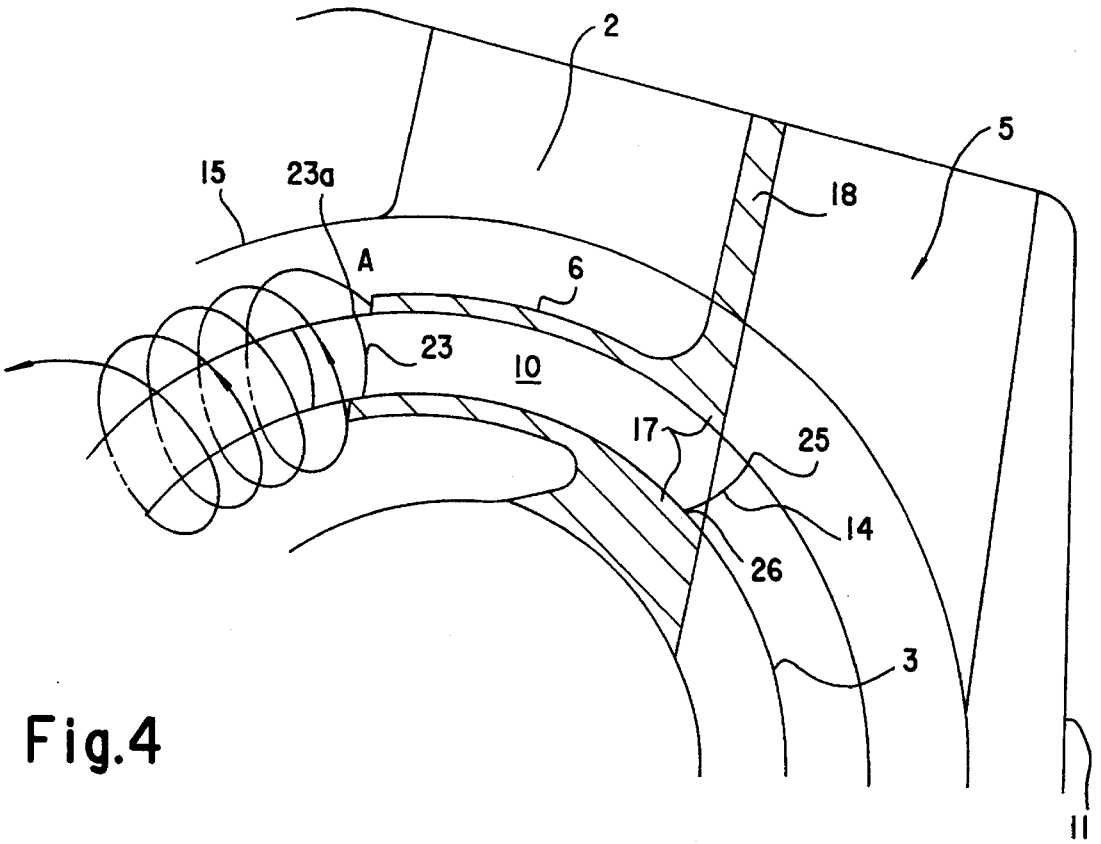
FIG. 4 shows a sectional side view of the stripper portion of a pump constructed in accordance with the present invention.

The construction shown in FIGS. 1 and 4 has blades 4, 14 or 23 configured to attain the advantage of reduced carryover loss. Normally, the operation of a regenerative pump, or blower, necessarily results in the entrapment of compressed fluid between the blades 4 travelling through the stripper portion 6 which results in a loss of the compressed fluid trapped between the blades 4 and carryover loss. In the embodiment shown in FIG. 4, it will be observed that the outer edge 25 of blade 14 is the last part of the blade 14 to enter the stripper portion 6 and thus enters after the inner edge 26 of blade 14 has entered the stripper portion 6. Thus, the entrapped air has the maximum opportunity of expulsion through the outlet port 5, thereby reducing carryover loss and increasing the efficiency of the blower 1.

It will also be noted that, in the construction as shown in FIG. 4, the outer edge 23*a* of the blade 23 leaves the stripper portion 6 first resulting in the expulsion of compressed air outwards toward the casing wall 15 at the earliest possible moment. This has two important consequences. Firstly, because such motion of compressed air causes the generation of the beneficial recursive spiral motion of air to obtain compression as indicated by the path A, efficiency is increased by providing more opportunity for such a motion to commence earlier. Secondly, the motion of the air in the blower casing 11 causes additional air to flow into the blower 1 through inlet port 2 due to the phenomenon of "jet entrainment". The increased volume of moving air at the inlet port 2 enables jet entrainment to occur at a higher efficiency.

During operation of the blower 1, incoming air is drawn into the casing 11, flowing over the stripper portion passage 10, as shown in FIG. 2*a*, to enter spaces between the blades 4. Upon impact by the blades 4, the air is projected by centrifugal force toward the wall 15 of the casing 11 whereupon it is guided towards a succeeding blade 4*a* which again impacts the air and the process continues. Each impact of air with the blades causes the air to be incrementally accelerated and, thus, compressed. Path A shows the direction of travel of the compressed gas. By the end of the passage of the air through the blower casing 11, the air has been compressed many times and the blower 1, in this way, acts as a multi-stage compressor.

The desirable location of the stripper portion 6 in a manner substantially coextensive with the inlet port 2, means that, in contrast with conventional blowers, a greater portion of the circumference of impeller 3 is available for compression and thus the compressive capacity of a blower 1 for a given size is increased. Such space savings are of great advantage in most applications, particularly engine applications.

Further advantage, in terms of reducing the space occupied by the blower 1, and the power requirements to operate it, can be gained by coupling the impeller 3 to the engine flywheel 12 by several bolts 13, one of which is shown in FIGS. 2*a* and 2*b*. In this way, the impeller 3 is enabled to rotate at the engine speed, which is a speed sufficient to provide the required compression of air with no additional transmission losses. Such an application requires a relatively "flat" blower construction, that is, the axial dimension of the blower is kept to a minimum with an inlet port 2 having an axial dimension not greater than the overall axial dimension of the casing 11 of the blower 1 and, therefore, requiring compensation in the form of a greater circumferential dimension so as to maintain the required cross-sectional area.

Figure 3:
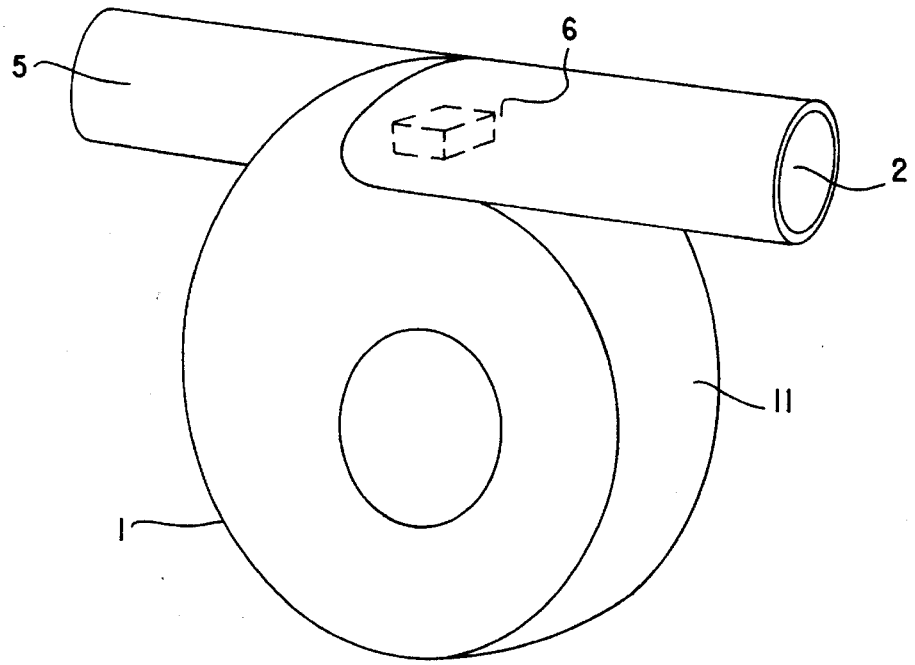
FIG. 3 shows a perspective view of the pump of FIGS. 1, 2*a* and 2*b* designed in accordance with a further embodiment of the present invention.

A further space saving may also be obtained by employing the construction as shown in FIG. 3. In the construction previously discussed, the inlet and outlet ports 2 and 5 lie in the same circumferential plane, but may still occupy too much of the peripheral length of the impeller 3. Thus, in an alternative construction, the blower casing 11 may be designed such that the inlet and outlet ports 2 and 5 themselves overlap in the circumferential direction. Hence, in FIG. 3 it can be seen that the inlet port 2 is tangential to the blower casing 11 and, similarly, the outlet port 5 is tangential to the blower casing 11. In this way, the size of the section of the periphery not available for pressure generation is reduced to a minimum. A further advantage also accrues, because the outlet port 5 is tangential to the blower casing 11, pressure loss or undesirable retarding effects due to compressed air colliding with an obstructive wall portion 18 of FIG. 1 is effectively eliminated.

The inlet and outlet ports 2 and 5 could be arranged in a number of different horizontal plane, not necessarily circumferential allowing flexibility in terms of the location and application of the blower.

It is to be understood that the above description is not to be taken as limitative of the invention and that workshop variations of the above produced by those skilled in the art do not depart from the scope of the invention. In particular, the pump disclosed herein may be used in applications other than internal combustion engines.

The claims defining the invention are as follows:

1. A regenerative pump to supply compressed fluid comprising a casing with a peripheral wall provided with an inlet port for admission of fluid to said casing and an outlet port, fixedly circumferentially spaced from said inlet port, for discharging of compressed fluid from the casing, an impeller having a plurality of spaced blade means for causing upon rotation, inducing fluid to the pump and for multi-stage compressing of said fluid, the inlet port being isolated from the outlet port by a stripper portion through which the blade means pass with spaces between the blade means isolated from the inlet port and the outlet port, when the spaces are passing through the stripper portion, said blade means having an outer edge and an inner edge with respect to a radial disposition of the blade means of said impeller wherein said stripper portion is located substantially coextensive in a circumferential direction with a substantial portion of one of said ports.

2. A regenerative pump to supply compressed fluid comprising a casing provided with an inlet port for admission of fluid to said casing and an outlet port for discharge of compressed fluid from the casing, an impeller having a plurality of spaced blade means for causing upon rotation, inducing of fluid to the pump and for multi-stage compressing of said fluid, the inlet port being isolated from the outlet port by a stripper portion through which the blade means pass with spaces between the blade means being in isolation from the inlet port and the outlet port when the spaces are passing through the stripper portion, said blade means having blades with an outer edge and an inner edge with respect to a radial disposition of said blade means of the impeller wherein said stripper portion is located substantially coextensive in the circumferential direction with a substantial portion of one of said ports.

3. A regenerative pump to supply compressed fluid comprising a casing provided with an inlet port for admission of fluid to said casing and an outlet port for discharge of compressed fluid from the casing, an impeller having a plurality of spaced blade means for causing upon rotation, inducing of fluid to the pump and for multi-stage compressing of said fluid, said inlet port being isolated from said outlet port by a stripper portion consisting entirely of a circumferentially extending body through which the blade means passes, said blade means having blades with an outer edge an inner edge with respect to a radial disposition of the blade means of the impeller wherein said stripper portion is located substantially coextensive in a circumferential direction is with a substantial portion of at least one of said ports.

4. A pump as claimed in claim 1, 2, or 3 wherein said stripper portion and said blade means are relatively configured such that said outer edge of each blade enters said stripper portion after said inner edge thereof.

5. A pump as claimed in claim 1, 2, or 3 wherein said stripper portion and said blade means are relatively configured such that said outer edge of each blade enters said stripper portion after said inner edge thereof.

6. A pump as claimed in claim 1, 2, or 3 wherein said outer edge of said blade means is a last portion of the blade means to enter said stripper portion.

7. A pump as claimed in claim 1, 2, or 3 wherein said outer edge of said blade means is a first portion of the blade means to exit said stripper portion.

8. A pump as claimed in claim 1, 2, or 3 wherein said inlet port has an axial dimension not greater than an axial dimension of said casing which is not greater than a circumferential dimension of said inlet port.

9. A pump as claimed in claim 1, 2, or 3 wherein said fluid flows through said inlet port over said stripper portion.

10. A pump as claimed in claim 1, 2, or 3 wherein guide means are provided relative to said impeller to maintain a flow of fluid towards an outer circumferential wall of said casing.

11. An internal combustion engine with a regenerative pump to supply compressed fluid comprising an internal combustion engine and a regenerative pump comprising a casing with a peripheral wall provided with an inlet port for admission of fluid to said casing and an outlet port, fixedly circumferentially spaced from said inlet port, for discharging of compressed fluid from the casing, an impeller having a plurality of spaced blade means for causing, upon rotation, inducing fluid to the pump and for multi-stage compressing of said fluid, the inlet port being isolated from the outlet port by a stripper portion through which the blade means pass with spaces between the blade means isolated from the inlet port and the outlet port, when spaces are passing through the stripper portion, said blade means having an outer edge and an inner edge with respect to a radial disposition of the blade means of said impeller wherein said stripper portion is located substantially coextensive in a circumferential direction with a substantial portion of ones of said ports.

12. An internal combustion engine with a regenerative pump to supply compressed fluid comprising an internal combustion engine and a regenerative pump comprising a casing provided with an inlet port for admission of fluid to said casing and an outlet port for discharge of compressed fluid from the casing, an impeller having a plurality of spaced blade means for causing upon rotation, inducing of fluid to the pump and for multi-stage compressing of said fluid, the inlet port being isolated from the outlet port by a stripper portion through which the blade means pass with spaces between the blade means being in isolation from the inlet port and the outlet port when the spaces are passing through the stripper portion, said blade means having blades with an outer edge and an inner edge with respect to a radial disposition of said means of the impeller wherein said stripper portion is located substantially coextensive in the circumferential direction with a substantial portion of one of said port.

13. An internal combustion engine with a regenerative pump to supply compressed fluid comprising an internal combustion engine and a regenerative pump comprising a casing provided with an inlet port for admission of fluid to said casing and an outlet port for discharge of compressed fluid from the casing, an impeller having a plurality of spaced blade means for causing, upon rotation, inducing of fluid to the pump and for multi-stage compressing of said fluid, said inlet port being isolated from said outlet port by a stripper portion consisting entirely of a circumferentially extending body through which the blade means passes, said blade means having blades with an outer edge and an inner edge with respect to a radial disposition of the blade means of the impeller wherein said stripper portion is located substantially coextensive in a circumferential direction with a substantial portion of at least one of said ports.

* * * * *